US010458111B1

(12) United States Patent
Bodine

(10) Patent No.: US 10,458,111 B1
(45) Date of Patent: Oct. 29, 2019

(54) SHOWER PAN DRAINAGE STABILITY APPARATUS

(71) Applicant: Catherine Bodine, Princeton, TX (US)

(72) Inventor: Catherine Bodine, Princeton, TX (US)

( * ) Notice: Subject to any disclaimer, the term of this patent is extended or adjusted under 35 U.S.C. 154(b) by 0 days.

(21) Appl. No.: 15/871,270

(22) Filed: Jan. 15, 2018

(51) Int. Cl.
*E03F 5/04* (2006.01)
*A47K 3/40* (2006.01)

(52) U.S. Cl.
CPC ..... *E03F 5/0408* (2013.01); *A47K 3/40* (2013.01)

(58) Field of Classification Search
CPC ..... E03F 5/048
USPC ..... 4/612–614
See application file for complete search history.

(56) References Cited

U.S. PATENT DOCUMENTS 5,299,836 A * 4/1994 Woods ..... E03F 5/0407 210/165
6,269,495 B1 * 8/2001 Sondrup ..... E03C 1/22 210/163
6,381,775 B1 * 5/2002 Sondrup ..... E03C 1/22 210/163
6,851,133 B1 * 2/2005 Nehring ..... A47K 3/40 4/612
8,060,956 B2 * 11/2011 DeGooyer ..... E03C 1/20 4/613
2007/0290082 A1 * 12/2007 Scorvo ..... E03C 1/266 241/20
2011/0197354 A1 * 8/2011 Wedi ..... A47K 3/40 4/613

* cited by examiner

*Primary Examiner* — Lori L Baker
(74) *Attorney, Agent, or Firm* — John D. Gugliotta

(57) ABSTRACT

A shower drain connector is provided having a vertical guide terminating at an upper end by a radial installation flange. The vertical guide forms a collar sleeve adapted to receive a drainage pipe in a contained manner. The collar sleeve has an inner diameter that larger than the outer diameter of a drain pipe being contained. The radial installation flange is less than or equal to 16 inches in diameter. A plurality attachment orifices adapted form connectors for receiving standard screw connectors positioned evenly radially about a periphery of the upper flange to allow for attachment of the flange to a subfloor such as to maintain a perfectly centered support for the drainpipe in spite of any on-site conditions.

15 Claims, 5 Drawing Sheets

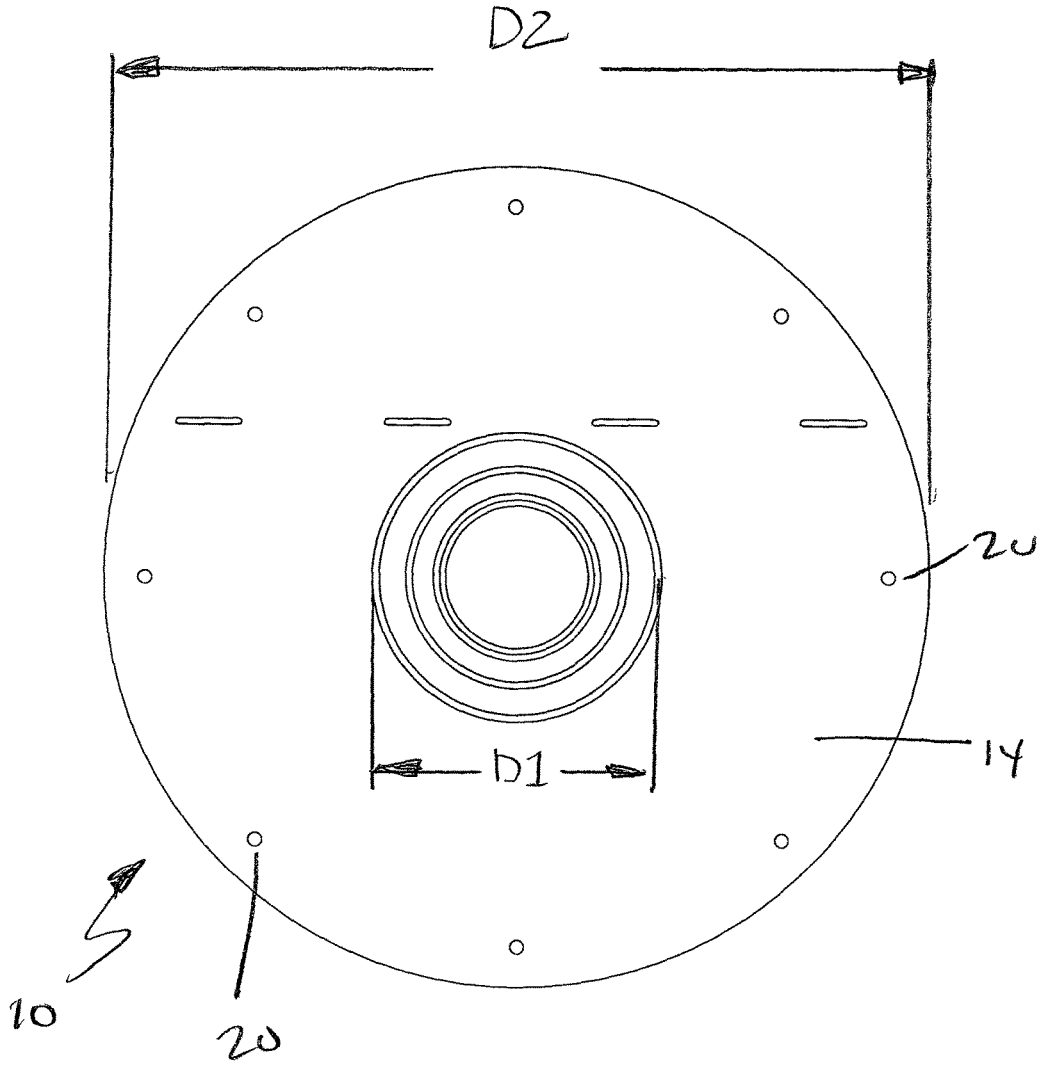
Figure # 1

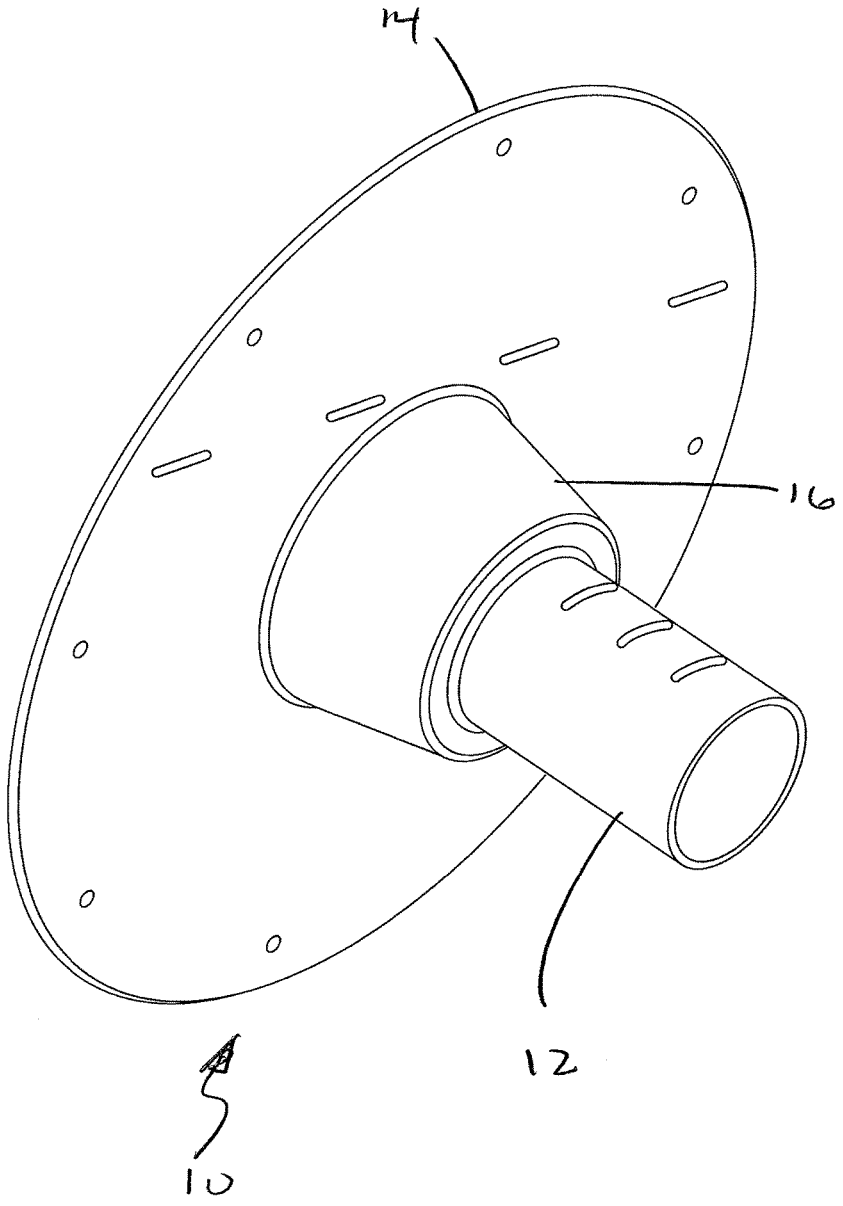
Figure # 2

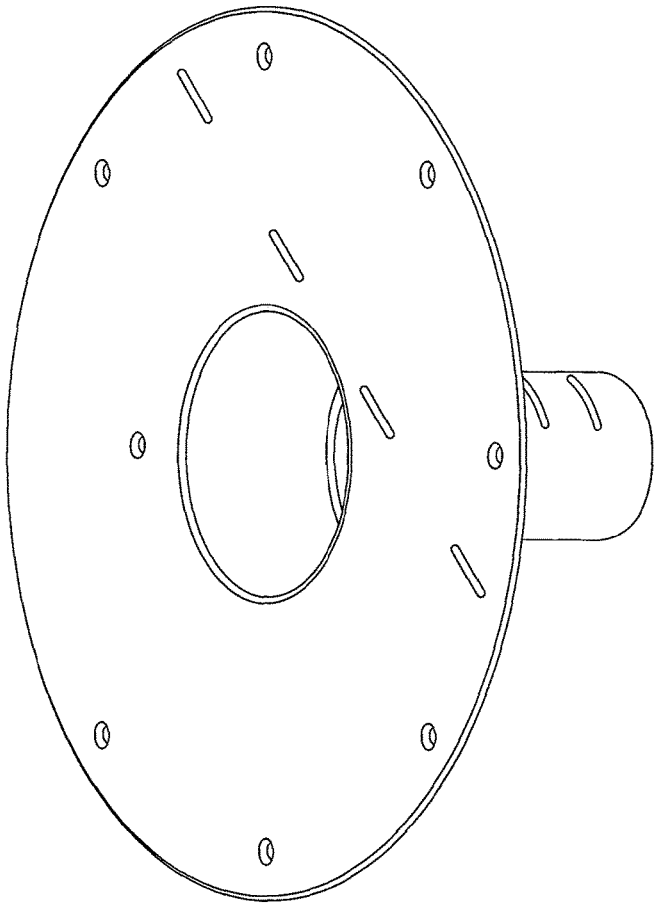
Figure # 3

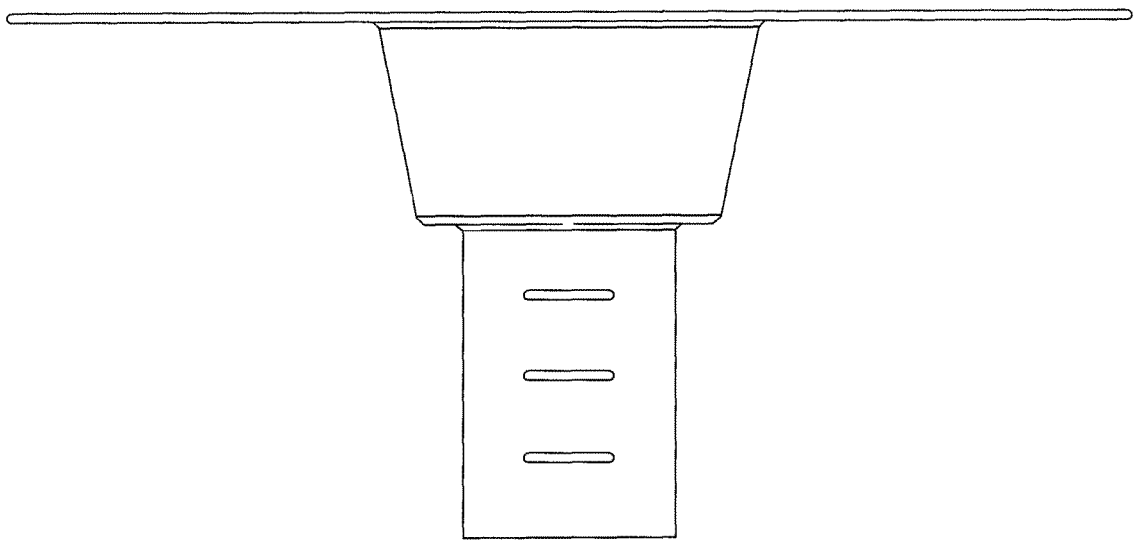
Figure # 4

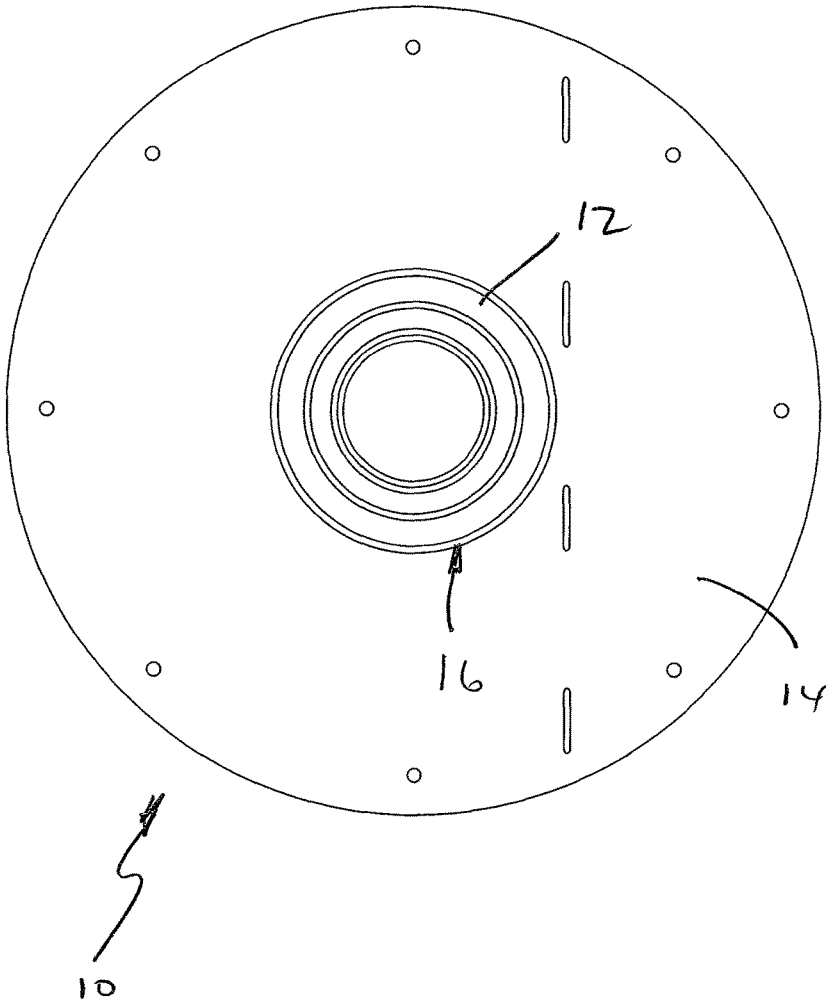
Figure # 5

SHOWER PAN DRAINAGE STABILITY APPARATUS

RELATED APPLICATIONS

There are no previously filed, nor currently any co-pending applications, anywhere in the world.

BACKGROUND OF THE INVENTION

1. Field of the Invention

The present invention relates to floor stability around the drain pipe in pier and beam structures for shower pan installation.

2. Description of the Related Art

The installation or construction of shower floors include a number of standard components, in stalled in layers. These include: a shower subfloor (including a pre-sloped layer); a shower pan; a mortar bed; a shower drain; and a floor surfacing material (e.g., ceramic tiles). With the installation of new showers it can present a problem if the drainpipe, generally installed on a much earlier time line than the remaining components of the shower, is not aligned properly with the dimensions of the shower pan such as to cause an excessive gap or spacing to allow for dimensional allowances during final connection. A similar problem occurs when a shower is the subject of a remodeling and new shower components are installed over an existing drain pipe. In such situations, there is likely a lack of alignment that will need to be accounted for.

In either scenario, the lack of exact alignment results in an orifice being created in the flooring larger than is otherwise needed for the passage of the plumbing conduit. This excessive gap may result, inter alia, in decreased structural integrity, wobbly pipes and undesired movements and noises with the drainage of water.

Consequently a need exists for a means to create a secure, centered drain connection between a shower floor pan and a drain pipe for both new and remodel installations.

SUMMARY OF THE INVENTION

It is thus an object of the present invention to provide to a device that aids in the installation of shower drains within a shower floor pan.

It is a feature of the present invention to provide a shower pan drain flange that secures between the shower pan and the drain pipe.

Briefly described according to the preferred embodiment of the present invention, a shower drain connector is providing having a vertical cylindrical guide terminating at an upper end by a radial installation flange. The vertical connection coupling forms a collar sleeve adapted to receive a drainage pipe in a nested, friction fit manner. The collar sleeve has an inner diameter that larger than the outer diameter of a drain pipe being connected. The radial installation flange is less than or equal to 16 inches in diameter. A plurality attachment orifices adapted form connectors for receiving standard screw connectors positioned evenly radially about a periphery of the upper flange to allow for attachment of the flange to a subfloor such as to maintain a perfectly centered support for the drainpipe in spite of any on-site conditions.

It is an advantage of the present invention to provide a support and stabilization structure for floors around shower pans to prevent failures at th drain pipes.

It is another advantage of the present invention to ensure a centered fit for all installations, either new construction or remodeling.

It is a further advantage of the present invention to provide a more rapid installation for such drain connections.

Further still, the present invention is easy to use, creates a strong and secure connection, and forms a consistent and repeatable connection for any type of shower installations.

Additional objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 1 is a bottom plan view of a shower pan drainage connector is shown according to the preferred embodiment of the present invention;

FIG. 2 is a bottom perspective view thereof;

FIG. 3 is an upper perspective view thereof;

FIG. 4 is a side elevational view thereof;

FIG. 5 is a top plan view thereof.

DESCRIPTION OF THE PREFERRED EMBODIMENTS

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the Figures.

1. Detailed Description of the Figures

Referring now to FIG. 1 through FIG. 5, wherein like reference numerals indicate the same parts throughout the several views, a shower drain connector, generally noted as 10, is shown according to the preferred embodiment of the present invention. The connector 10 comprises a vertical guide coupling 12 terminating at an upper end by a radial installation flange 14. The vertical guide coupling 12 provides a collar sleeve 16 that receives a drainage pipe 100 for either a new construction or remodeling installation. The collar sleeve 16 has a diameter D1 that slightly larger than the outer diameter of the drain pipe 100 being connected. It should be apparent to one having ordinary skill in the relative art, in light of the present teachings, that various sizes of the collar sleeve 16 may be provided to accommodate various standard size plumbing conduits. As such, a series of such sizes to accommodate such standard sized plumbing conduits for use in shower drain connections. The radial installation flange 14 circumscribes the periphery of the upper end of the guide coupling 12. The installation flange 14 is intended to have an outer diameter D2 that is sufficiently wide as to span across the openings created through floors for the passage of plumbing. While such installation will be described in greater detail below, according to one aspect of the present invention the installation flange 14 may have an outer diameter D2 of approximately six inches.

According to another aspect of the present invention, the installation flange 14 may have an outer diameter D2 greater than six inches. Further, according to another aspect of the present invention the installation flange 14 may have an outer diameter D2 of a dimension three times that of the plumbing conduit drain pipe. Due to the function of the flange 14, as better described in greater detail below, to create a spanning connection that is centered about the location of the drain pipe and provide a plurality of connections 20 between the flange 14 and the shower floor (and beneath the floor pan), it is anticipated that the flange 14 would have an optimal diameter less than a certain maximum dimension. Standard shower floor pans exist in 4 foot, 6 foot or 8 foot sections, and standard flooring trusses are positioned at 16 inch or 24 inch centers. As such, it is felt that an optimal maximum diameter D2 would likely not exceed 16 inches.

The flange 16 may further form a plurality of attachment orifices 22. The attachment orifices 22 may be for receiving standard screw connectors, and may be positioned evenly radially about the periphery of the upper flange 14.

2. Operation of the Preferred Embodiment

In operation, the present invention is used to facilitate the installation of a drain connection between a shower floor and a drain pipe. As shown, the invention provides a structural reinforcement that is in combination with other conventional elements to form the floor of a shower or similar bathroom structure.

In wood-frame construction, shower floors are typically formed by first putting a moisture barrier over a wooden subfloor after which a mortar bed is sloped to the position of the drain, typically referred to as sloped fill, or "pre-slope." A waterproof barrier, commonly referred to as a shower pan liner, is subsequently positioned over the sloped mortar bed and fixed to the drain. Conventional shower pan liners are not designed to bond to a substrate or to ceramic or stone tile and thus a second "floating" (non-bonded) mortar bed must be overlaid to provide a load distribution layer and bonding surface for the tile. To have sufficient strength, such non-bonded mortar beds for shower floors should have a minimum thickness (typically 1.5 inches) and should be reinforced with galvanized wire mesh to comply with industry standard guidelines.

This method of shower floor construction has proven over time to be reliable when properly built, but requires a high degree of trade knowledge and skill, and takes considerable time. Further, a key weakening factor includes both the removal of flooring material in order to accommodate the drain (i.e. the size of the material removed) as well as the relative location of the passage as it relates to both the drainpipe and the drain orifice (i.e. the centering of the drain).

This conventional construction method can be improved with minimal training or method modification when using the present invention, as shown best in conjunction with FIG. 6*b*. In such a modification, the flange 18 is attached further form a plurality of attachment orifices 22. The attachment orifices 22 is secured to the subfloor before application of the mortar bed. The radial flange provides a secure mechanical bond to the subfloor and supports the vertical drainpipe in a manner to withstand lateral stresses. Once attached to span the drain opening and secured to the subfloor, the remainder of the installation process can be completed as normal.

The result is an integrated system having a supreme structural integrity while still being able to accommodate the remaining shower floor installation materials, methods and techniques.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

What is claimed is:

1. A shower drain connector support system comprising:

vertical guide terminating at an upper end by a radial installation flange and forming a concave lower end, said radial installation flange adapted to be rigidly affixed between a shower drain pan and a floor;

a collar sleeve depending from said concave lower end adapted to receive a drainage pipe in a contained manner; and said collar sleeve extending upward within the concave lower end and having a first inner diameter larger than a second outer diameter of a drain pipe being contained; and said concave lower end adapted such as to allow motor to be filled between a space formed between a concave lower end inner wall and said collar sleeve outer wall.

2. The shower drain connector of claim 1, further comprising:

said radial installation flange adapted to circumscribe a periphery of the upper end of the cylindrical guide.

3. The shower drain connector of claim 2, wherein said installation flange further comprises a second outer diameter that is sufficiently wide as to span across an opening created through a floor for the passage of plumbing.

4. The shower drain connector of claim 3, wherein said second outer diameter is at least approximately six inches.

5. The shower drain connector of claim 3, wherein said second outer diameter is greater than six inches.

6. The shower drain connector of claim 3, wherein said second outer diameter has dimension at least three times that of said first outer diameter.

7. The shower drain connector of claim 3, further comprising a plurality of connections between the flange and a shower floor beneath a floor pan.

8. The shower drain connector of claim 4, further comprising a plurality of connections between the flange and a shower floor beneath a floor pan.

9. The shower drain connector of claim 5, further comprising a plurality of connections between the flange and a shower floor beneath a floor pan.

10. The shower drain connector of claim 6, further comprising a plurality of connections between the flange and a shower floor beneath a floor pan.

11. The shower drain connector of claim 7, wherein the second outer diameter does not exceed 16 inches.

12. The shower drain connector of claim 7, wherein plurality of connections comprise a plurality of attachment orifices adapted for receiving standard screw connectors and positioned evenly radially about a periphery of the upper flange.

13. The shower drain connector of claim 8, wherein plurality of connections comprise a plurality of attachment orifices adapted for receiving standard screw connectors and positioned evenly radially about a periphery of the upper flange.

14. The shower drain connector of claim 9, wherein plurality of connections comprise a plurality of attachment orifices adapted for receiving standard screw connectors and positioned evenly radially about a periphery of the upper flange.

15. The shower drain connector of claim 10, wherein plurality of connections comprise a plurality of attachment orifices adapted for receiving standard screw connectors and positioned evenly radially about a periphery of the upper flange.

* * * * *